US011279530B2

(12) United States Patent
Wilson

(10) Patent No.: US 11,279,530 B2
(45) Date of Patent: Mar. 22, 2022

(54) CHILD-RESISTANT CAP

(71) Applicant: Cory J. Wilson, East Lansing, MI (US)

(72) Inventor: Cory J. Wilson, East Lansing, MI (US)

( * ) Notice: Subject to any disclaimer, the term of this patent is extended or adjusted under 35 U.S.C. 154(b) by 152 days.

(21) Appl. No.: 16/421,631

(22) Filed: May 24, 2019

(65) Prior Publication Data

US 2019/0276202 A1 Sep. 12, 2019

Related U.S. Application Data

(63) Continuation-in-part of application No. 15/826,148, filed on Nov. 29, 2017, now abandoned.

(51) Int. Cl.
*B65D 50/04* (2006.01)
*B65D 50/00* (2006.01)

(52) U.S. Cl.
CPC ..... *B65D 50/043* (2013.01); *B65D 50/00* (2013.01); *B65D 2215/06* (2013.01)

(58) Field of Classification Search
CPC .. B65D 50/041; B65D 50/043; B65D 50/046; B65D 50/061; B65D 50/00; B65D 41/06; B65D 51/245; B65D 55/026; B65D 2215/02; B65D 2215/06
USPC ..... 215/201, 217–220, 221, 224–225, 230, 215/274–275; 220/254.1, 254.8–254.9, 220/255, 256.1, 257.2, 259.3–259.4, 315, 220/319–320
See application file for complete search history.

(56) References Cited

U.S. PATENT DOCUMENTS 2,767,680 A 10/1956 Lermer
3,073,468 A * 1/1963 Arneson ..... B65D 55/026 215/230
3,151,599 A * 10/1964 Livingston ..... A61J 7/04 116/308
3,472,411 A * 10/1969 Turner ..... B65D 50/041 215/220
3,722,727 A * 3/1973 Gach ..... B65D 50/041 215/220
3,915,326 A 10/1975 Hrubesky
3,926,328 A 12/1975 Cistone
(Continued)

FOREIGN PATENT DOCUMENTS

EP 0 627 357 A1 12/1994

OTHER PUBLICATIONS

Transmittal of the International Search Report and Written Opinion of the International Searching Authority, dated Mar. 12, 2019 (10 pages).

*Primary Examiner* — Chun Hoi Cheung
*Assistant Examiner* — Brijesh V. Patel
(74) *Attorney, Agent, or Firm* — Gunther J. Evanina; Butzel Long, P.C.

(57) ABSTRACT

A child-resistant closure for a container includes an inner cap retained in an outer cap, the outer cap being rotatable with respect to the inner cap; the inner cap having a gripping surface on a circumferential sidewall; the outer cap having a circumferential lateral wall defining at least one elongate cutout that exposes the gripping surface, the cutouts providing adequate contact area between a typical thumb and/or fingers of an adult and the exposed gripping surface to allow removal of the closure from a container, and inadequate contact area between a typical thumb, finger and/or hand of a child to allow removal of the closure.

14 Claims, 5 Drawing Sheets

(56) References Cited

U.S. PATENT DOCUMENTS 3,934,744 A * 1/1976 Curry ..... B65D 50/041 215/219
3,960,713 A * 6/1976 Carey ..... A61J 7/04 206/534
4,002,258 A 1/1977 Curry
4,220,247 A * 9/1980 Kramer ..... A61J 7/04 116/308
4,271,971 A * 6/1981 Morris ..... B65D 50/068 215/203
4,347,804 A 9/1982 Villa-Real
4,365,722 A * 12/1982 Kramer ..... A61J 7/04 215/220
4,573,598 A * 3/1986 Perry ..... B65D 50/061 215/204
4,705,181 A * 11/1987 Burke ..... B65D 50/041 215/213
4,792,664 A * 12/1988 Schwab ..... G06M 1/083 235/103
5,918,752 A 7/1999 Meyer
6,085,920 A * 7/2000 Moretti ..... B65D 41/34 215/220
6,089,180 A * 7/2000 Nichols, Jr. ..... G09F 11/23 215/230
6,112,921 A * 9/2000 Robinson ..... B65D 50/046 215/216
D470,051 S * 2/2003 Bloom ..... B65D 47/0804 D9/435
6,655,553 B2 * 12/2003 Staniszewski ..... B65D 50/046 215/219
6,942,115 B2 * 9/2005 Jimenez ..... B65D 23/0885 215/277
7,111,746 B2 * 9/2006 Miceli ..... B65D 50/041 215/219
7,510,094 B1 * 3/2009 Willis ..... B65D 50/043 215/218
7,878,350 B2 * 2/2011 Ramoundos ..... G09F 11/04 215/230
8,205,761 B2 * 6/2012 Stull, Sr. ..... B65D 83/06
8,286,812 B2 * 10/2012 Buczkowski ..... A61J 7/0481 215/230
8,316,622 B2 * 11/2012 Jajoo ..... A61J 7/04
8,590,719 B2 11/2013 Sprishen et al.
8,627,968 B2 * 1/2014 Baban ..... B65D 55/022 215/220
8,936,157 B1 * 1/2015 Xu ..... B65D 47/265 206/533
9,102,449 B2 * 8/2015 Gatton ..... B65D 83/06
9,492,356 B2 * 11/2016 Balakier ..... A61J 1/03
9,622,939 B2 * 4/2017 Buxton-Dakides ..... A61J 1/03
2004/0169000 A1 * 9/2004 Ramsey ..... B65D 50/046 215/219
2010/0147732 A1 * 6/2010 Delagrange ..... B65D 47/0804 206/528
2011/0284415 A1 * 11/2011 Balakier ..... B65D 41/06 206/459.1
2013/0292354 A1 * 11/2013 Xu ..... A61J 7/04 215/230
2014/0014611 A1 * 1/2014 Buehler ..... B65D 50/041 215/217
2015/0014269 A1 1/2015 Gillman
2016/0120760 A1 * 5/2016 Nazginov ..... A61J 7/0481 215/230
2016/0176590 A1 6/2016 Prater et al.
2016/0280428 A1 * 9/2016 Philip ..... B65D 50/041
2016/0288965 A1 * 10/2016 Yeager ..... B65D 50/041
2017/0035659 A1 2/2017 Balakier et al.
2017/0202748 A1 * 7/2017 Gosselin ..... H04L 1/02
2017/0225834 A1 * 8/2017 Peng ..... B65D 23/14
2018/0250196 A1 * 9/2018 Warden ..... A61J 1/18
2018/0370700 A1 * 12/2018 Gregori ..... B65D 50/045

* cited by examiner

CHILD-RESISTANT CAP

CROSS-REFERENCE TO RELATED APPLICATIONS

This application is a continuation-in-part of U.S. application Ser. No. 15/826,148, filed Nov. 29, 2017, which is incorporated herein by reference in its entirety.

FIELD OF THE DISCLOSURE

This disclosure pertains to child-resistant packaging and more particularly to internally threaded caps or closures that are highly resistant to removal from a container by a child, but which can be easily removed by an elderly, weak or infirm adult.

BACKGROUND OF THE DISCLOSURE

Child-resistant locking closures were invented in the 1960's, and have been widely used as a last line of defense against the risk of children ingesting dangerous materials. The Poison Prevention Packaging Act requires the use of child-resistant packaging for most prescription drugs, over-the-counter drugs, household chemicals, and other hazardous materials that could be dangerous for children.

There are now hundreds of child-resistant packaging designs available. Most of these designs require two dissimilar motions for opening, which are intended to be easy for adults, yet difficult for children. However, the U.S. Consumer Product Safety Commission has stated that there is no such thing as child-proof packaging. Thus, the objective is to design packaging that denies access to most children, while allowing access to most adults. Existing child-resistant packaging is reasonably effective at preventing most children from opening such containers, while allowing most adults easy access to the contents of such containers. However, because most of these designs rely on a disparity between the knowledge, strength and/or dexterity of the typical adult as compared with the typical child, there are precocious and/or unusually strong or dexterous children that will be able to open existing child-resistant packaging, and there are weak, elderly or infirm adults that will be denied access to the contents of child-resistant packaging.

Thus, there is a need for an improved child-resistant cap or closure for a container that allows fewer children to open the container and also allows more adults to open the container.

SUMMARY OF THE DISCLOSURE

The disclosed child-resistant closure has a screw-on inner cap covered by an outer cap. A gripping surface on a sidewall of the inner cap is exposed through at least one cutout in the outer cap. The cutout or cutouts limit contact between the fingers and hands of a user and the inner cap to an area of the gripping surface that is sufficient to allow an adult to apply the force needed to remove the cap from a container, while being too small to allow a child, especially a smaller child to contact a sufficiently large area of the gripping surface to allow removal of the closure from the container.

DESCRIPTION OF THE ILLUSTRATED EMBODIMENTS

Figure 1:
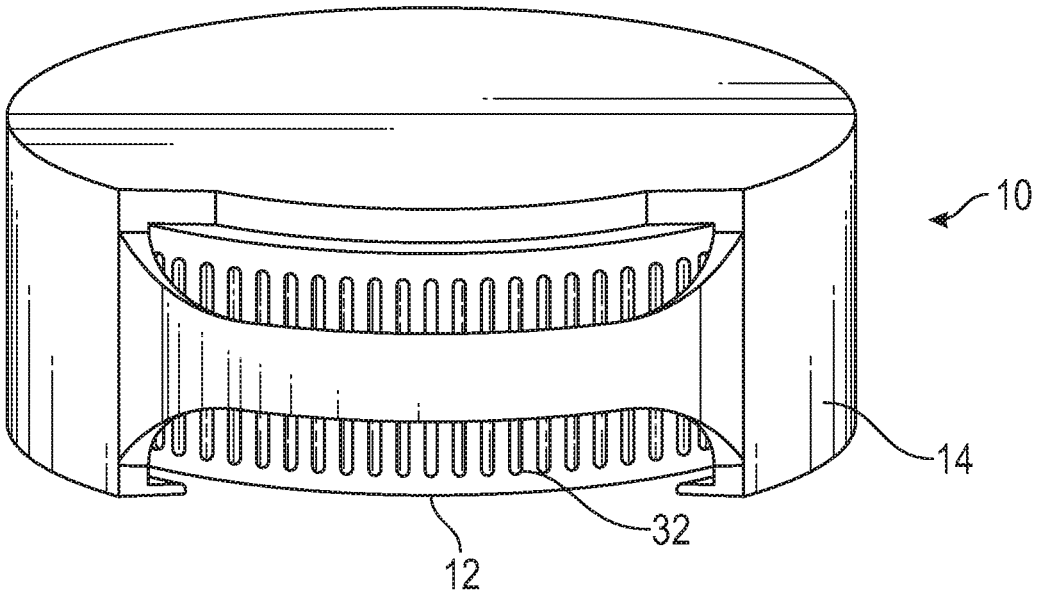
FIG. 1 is a perspective view of a child-resistant closure in accordance with this disclosure.
Figure 2:
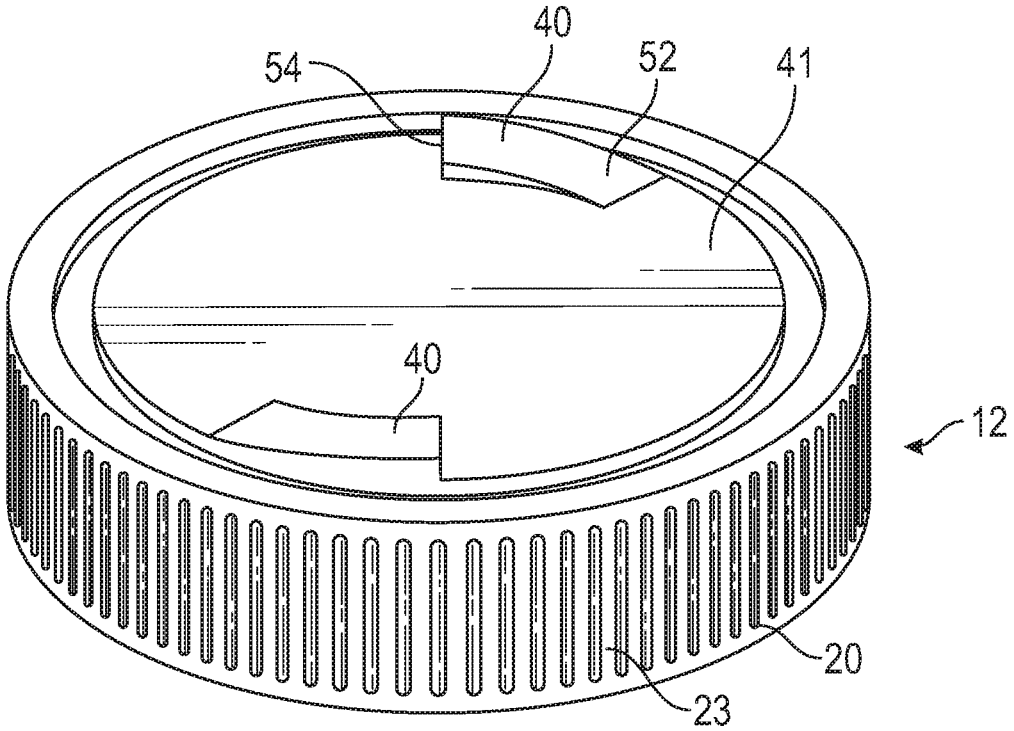
FIG. 2 is a top perspective view of the inner cap of a child-resistant closure in accordance with this disclosure.
Figure 3:
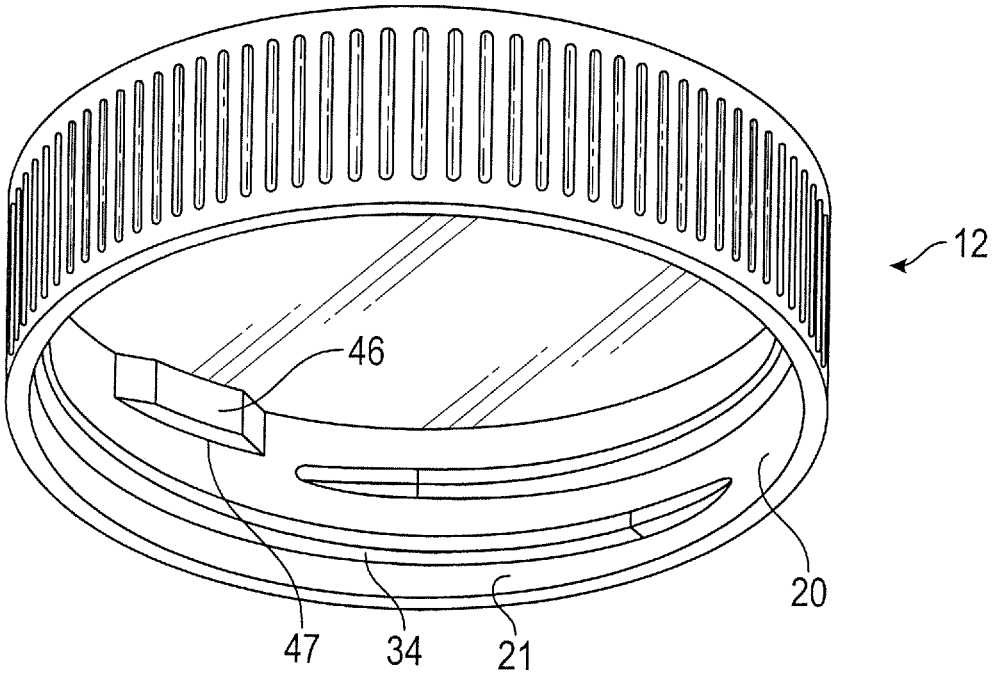
FIG. 3 is a bottom perspective view of the inner cap of the child-resistant closure.
Figure 4:
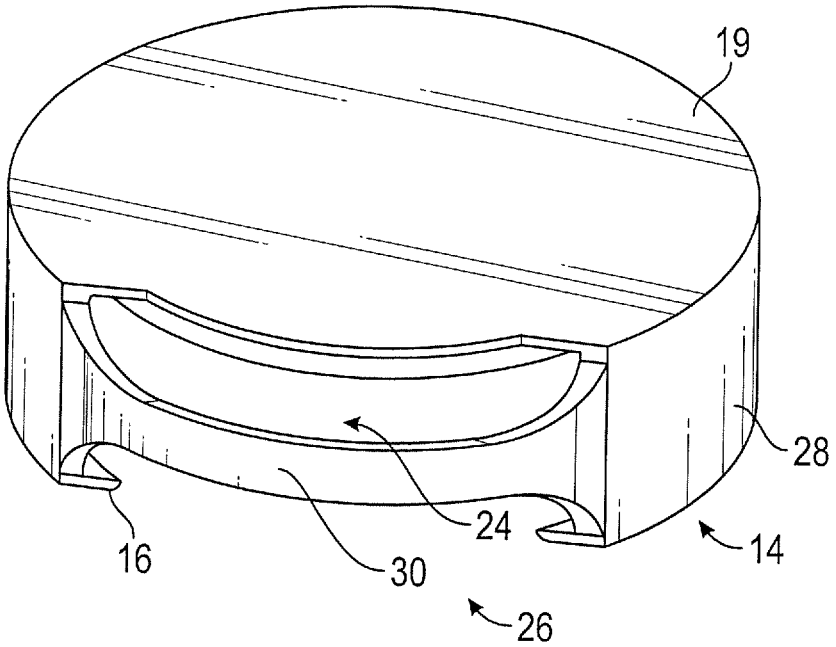
FIG. 4 is a top perspective view of the outer cap of the child-resistant closure.
Figure 5:
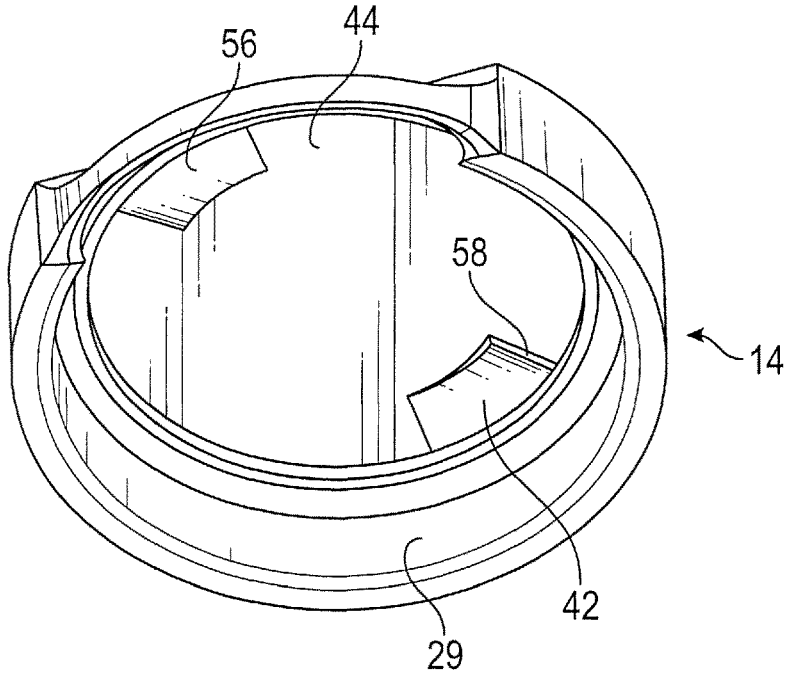
FIG. 5 is a bottom perspective view of the outer cap of the child-resistant closure.

Shown in FIG. 1 is a child-resistant closure 10 in accordance with this disclosure. Closure 10 includes an inner cap 12 (shown in FIGS. 2 and 3), and an outer cap 14 (shown in FIGS. 4 and 5). As shown in FIG. 1, inner cap 12 is nested within and retained by outer cap 14.

Outer cap 14 includes a lip portion 16 that extends radially inwardly of a lateral wall 28 that depends from a top wall 19. In the illustrated embodiment, lip portion 16 is located at a bottom edge of wall 28, but could conceivably extend from an interior side 29 of wall 28 disposed in spaced relation to the bottom edge of wall 28. Lip portion 16 retains inner cap 12 within outer cap 14 so that it cannot be easily separated from the outer cap when the closure 10 is completely removed from a container.

Figure 6:
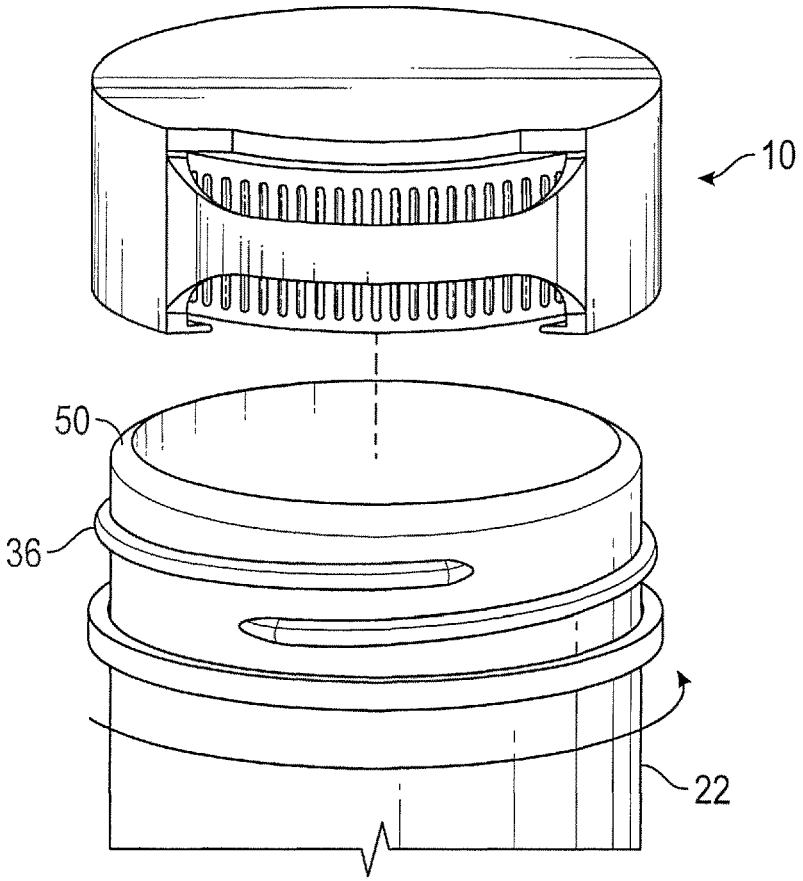
FIG. 6 is an exploded perspective view showing threading engagement between the child-resistant closure and a container.

Inner cap 12 includes a top wall 41 and a depending circumferential side wall 20 having an interior surface 21 provided with internal threads 34 for engaging external threads 36 on a bottle 22 (see FIG. 6), and an exterior surface 23 provided with gripping features 32. In the illustrated embodiment, gripping features 32 comprise a plurality of parallel elongate protuberances or ribs that extend vertically (i.e., parallel to the screw axis of cap 12), however, other types of gripping features can be employed, such as hemispherical bumps, knurls, or the like. The interior side 29 of wall 28 is smooth and substantially free of protuberances, undulations or other relief features to minimize engagement between the interior surfaces 29 of outer cap 14 and the gripping features 32 of inner cap 12. The smoothness of the interior surfaces 29 of outer cap 14 prevents the application of forces applied to the exterior surfaces of wall 28 of outer cap 14 to be transferred to the exterior surface 23 of inner cap 12 or gripping features 32. Rather, torque applied to exterior surfaces of wall 28 of outer cap 14 would cause only the outer cap 12 to rotate with interior surfaces of outer cap 14 sliding along exterior surfaces of inner cap 12. This prevents a child from using gross motor control and large muscles to effect removal of the closure. Frictional engagement can be further reduced or eliminated by using a stiffer outer cap and/or providing an annular gap between the exterior lateral surfaces of the inner cap and interior lateral surfaces of the outer cap.

The lateral wall 28 includes an upper elongate cutout section 24 and a lower elongate cutout section 26 that is spaced from the cutout 24 and separated from cutout 24 by a bridge portion 30. Cutouts 24 and 26 expose gripping features 32 on exterior surface 23 of sidewall 20 of inner cap 12. The cutouts 24 and 26 are sized so that substantially the entire surface of the thumb of a typical adult can contact either the exposed gripping features 32, whereas the thumb of a typical child would contact a substantially reduced area of the exposed gripping surfaces. Therefore, a child would need to apply substantially more thumb pressure in order to apply the amount of force needed to unscrew closure 10 from a bottle 22. For example, a typical adult has a distal phalanx portion of the thumb that is about 30 mm long and about 20 mm wide, whereas a typical child might have a distal phalanx portion of the thumb that is about 25 mm by 15 mm. Thus, if the cutouts 24 and 26 are sized to have a length along the circumference that is about 30 mm and widths that are each about 6 mm with the bridge having a width of about 8 mm, the thumb of the typical adult would contact about 360 square millimeters of the exposed gripping surface, whereas the thumb of the typical child would contact only about 175 square millimeters. Therefore, if the closure is designed so that a predetermined amount of pressure must be exerted on the gripping surface to allow a typical adult to remove the closure 10 from a bottle 22, a typical child would be required to apply more than twice the amount of pressure needed by the typical adult to remove the closure. Stated differently, an adult-size thumb can wrap around the bridge 30 to apply pressure and torque to inner cap 12, whereas a child-size thumb cannot wrap around bridge 30 to allow sufficient contact with the exposed gripping surface.

The amount of effort needed to open the bottle 22 can be controlled by appropriate design of the threads (e.g., pitch, lead, thread angle, thread depth, etc.), and by providing the closure with a stop 46 that prevents over-tightening of closure 10 onto a bottle 22. Stop 46 is located on the interior surface 21 of wall 20 of inner cap 12, and includes a bottom or stop surface 47 that engages an upper edge surface 50 of bottle 22 to ensure that the amount of torque or force needed to remove closure 10 does not vary appreciably after it is tightened onto bottle 22.

In the illustrated embodiment, inner cap 12 is provided with one-way ratchet ramps 40 on the upper surface of top wall 41. Ramps 40 each include a sloped surface 52 and a stop surface 54. Outer cap 14 can be provided with one-way ratchet ramps 42 on bottom surface 44 of top wall 19. Each of ramps 42 includes a sloped surface 56 and a stop surface 58. In the illustrated embodiment, clockwise rotation of outer cap 14 causes outer cap 14 and inner cap 12 to lock and rotate together when stop surfaces 54 and 58 contact. Counterclockwise rotation of outer cap 14 causes caps 12 and 14 to slip or slide past each other as sloped surfaces 52 and 56 engage, causing only outer cap 14 to rotate unless adequate pressure is applied to the surfaces of inner cap 12 exposed through cutouts 24 and 26.

Figure 7:
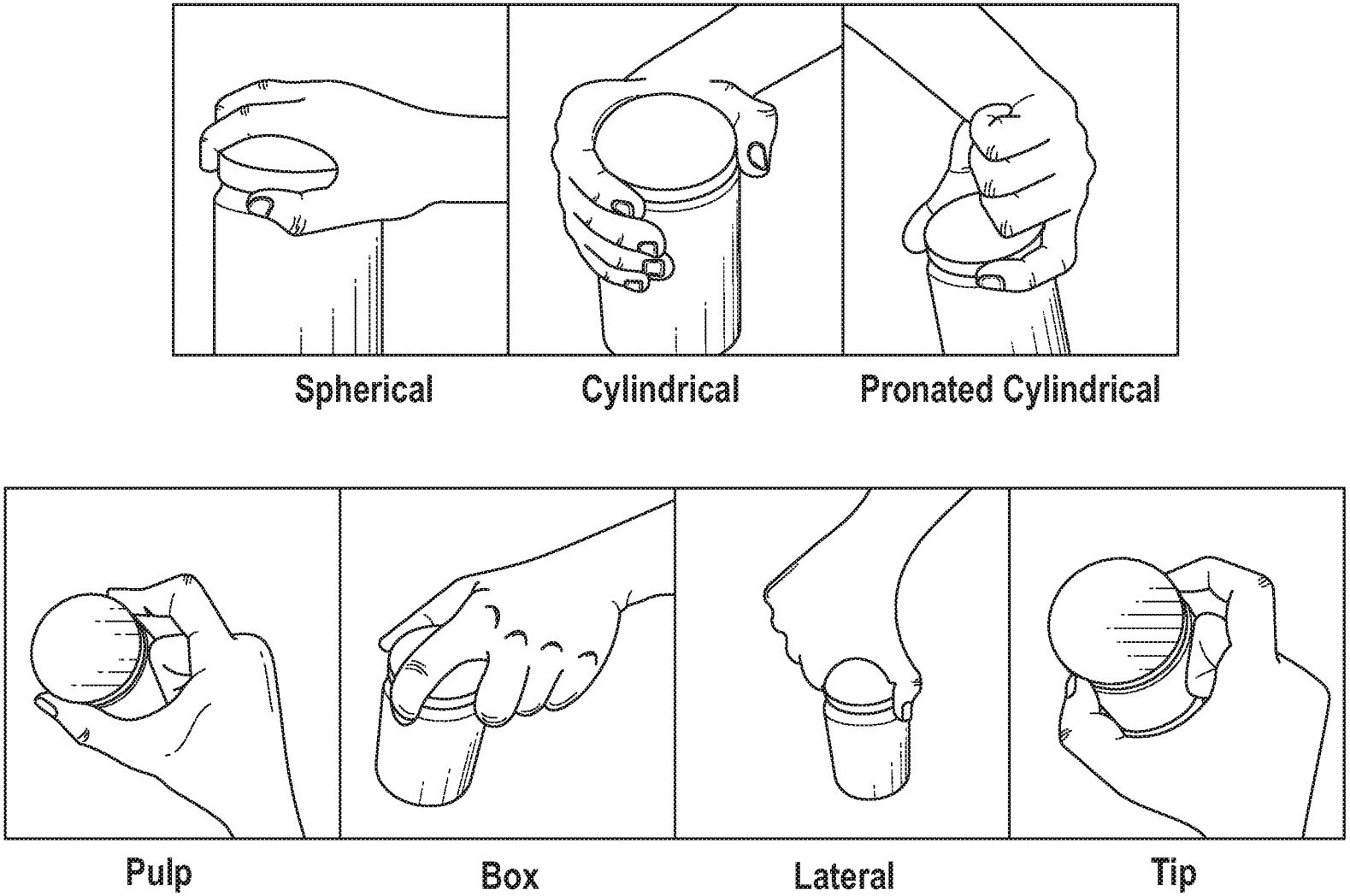
FIG. 7 is an illustration of seven common techniques for removing a screw-on lid from a container.

It has been determined that most people remove screw-on lids or caps from containers, such as medicine bottles, using one of seven different techniques illustrated in FIG. 7. These techniques utilize both gross and fine motor control but can be categorized as either one of three techniques predominantly utilizing gross motor control or one of four techniques predominantly utilizing fine motor control to execute the gripping technique. Those techniques predominantly involving gross motor control rely on maximizing contact between the peripheral side wall and/or top of the lid or cap and the fingers and/or hand of the user. The "cylindrical" and "pronated cylindrical" techniques, each maximize contact with the peripheral side wall of the lid by placing the length of the index or middle finger, length of the thumb, and a portion of the hand between the index (or middle, ring, little finger) and thumb against the side wall; and using larger hand/wrist muscles to achieve a grip that is strong enough to remove the lid: the difference between the techniques being the palm facing in the opposite direction of a comparable cylinder grip when the pronated cylindrical grip is employed. The four commonly used techniques for removing a screw-on lid from a container that predominantly employ fine motor control do not principally rely on contact between the hand and lid, but instead primarily involve contact between the finger(s) and thumb and the side wall of the lid. These techniques generally involve contacting only the tip and/or pulp of the index finger and thumb at opposing peripheral surfaces of the lid, the exception being the "box" technique, which involves placement of the thumb pulp and side of the middle finger knuckle on opposite lid surfaces, and the index finger tip and/or pulp on a peripheral side surface of the lid approximately half-way between the surfaces contacted by the middle finger and thumb. In each of the techniques involving fine motor control, the grip needed to facilitate removal of the lid is established and maintained primarily by using the fingers and thumb.

It has been discovered that children, especially smaller children that are at risk of ingesting potentially harmful substances (e.g., prescription drugs), generally rely on one of the techniques that predominantly utilize gross motor control, because use of fine motor control is typically underdeveloped in smaller children. In contrast, it has been discovered that adults (without physical or cognitive impairments that affect their ability to open screw-on lid containers) more frequently use techniques that predominantly utilize fine motor control to remove a screw-on lid from a container.

The child-resistant caps of this disclosure are designed to significantly limit the efficacy of techniques that predominantly utilize gross motor control for removing a screw-on cap from a bottle or other container. More precisely, the disclosed designs prevent contact between the top of the inner cap and the fingers or hands of a user attempting to remove the lid, and also severely limits contact with the peripheral side wall of the inner cap, allowing substantially all adults (without physical or cognitive impairment that affect their ability to open screw-on lid containers), including the elderly, to remove the lid, while preventing substantially all children under the age of five from removing the lid.

Figure 8:
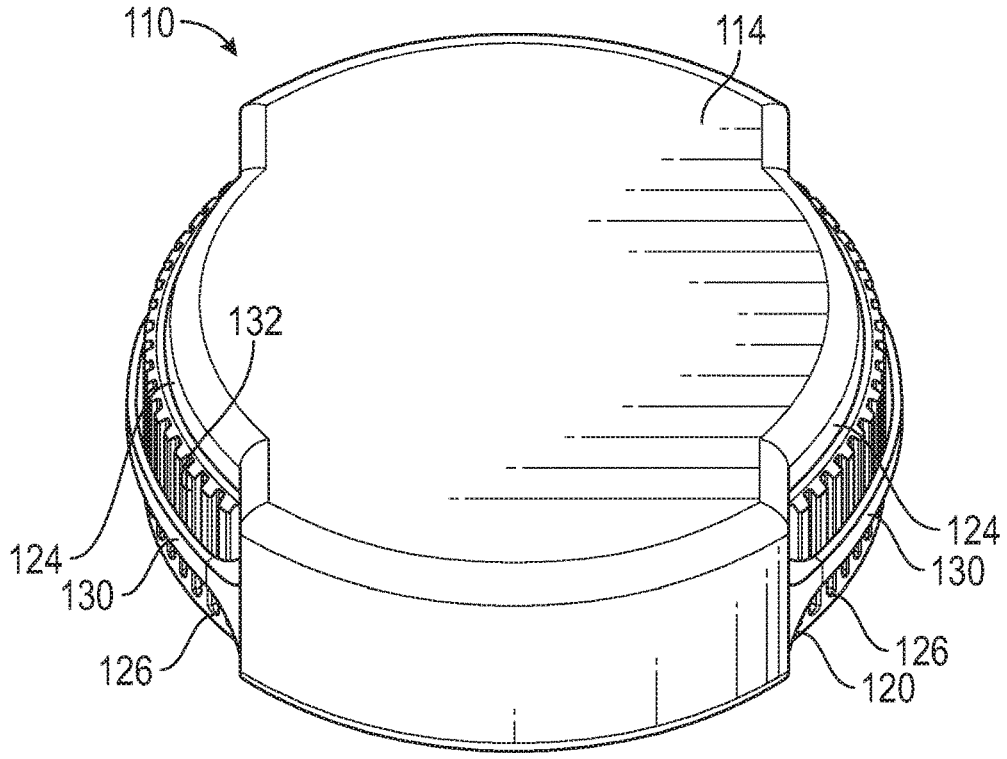
FIG. 8 is a perspective view of an alternative embodiment of a child-resistant closure in accordance with this disclosure.

Shown in FIG. 8 is an alternative embodiment 110 similar to that shown in FIGS. 1-6, but with the outer cap 114 having two upper elongate cutout sections 124 and two lower elongate cutout sections 126, each upper elongate cutout separated from a corresponding lower elongate cutout by a bridge portion 130. The cutouts expose areas of exterior surface 123 and gripping features 132 of side wall 120 sufficient to allow an adult to position an index finger tip or pulp on one side of the inner cap and a thumb tip or pulp on the opposite side, and apply sufficient pressure and torque to facilitate removal of the closure 110 from a container, while preventing a child from removing the cap in a similar manner or from employing gross motor control and large muscles. Specifically, the cutouts limit exposure of the exterior surface 123 and gripping features 132 to an area that is not large enough to facilitate contact with surfaces of the user's hand, fingers and/or thumb that would allow closure removal techniques employing gross motor control and large muscles.

Figure 9:
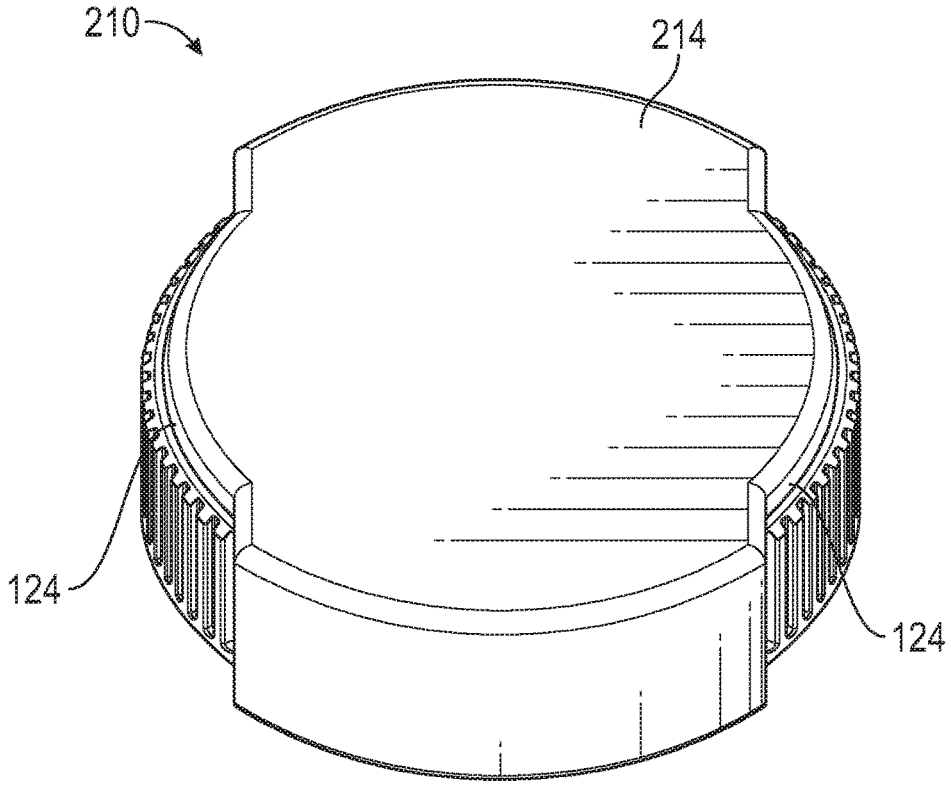
FIG. 9 is a perspective view of another alternative embodiment of a child-resistant closure in accordance with this disclosure.

Another alternative closure 210 similar to closure 110 is shown in FIG. 9. Closure 210 differs from closure 110 by eliminating bridge portions 130. Rather, outer cap 214 has two cutouts 124 on opposite sides of closure 210. The elimination of bridge portions 130 improve the efficacy of fine motor control grip interfaces while maintaining reduced efficacy of gross motor control grip interfaces. Stated differently, the elimination of bridge portions 130 make it easier for elderly or infirm adults to remove the closure, while still preventing the effective use of gross motor control and large muscles, typically employed by children to remove screw-on caps from containers.

The above description is intended to be illustrative and not restrictive. Many embodiments and applications other than the examples provided would be apparent upon reading the above description. The scope of the invention should be determined with reference to the appended claims along with the full scope of equivalents to which such claims are entitled. It is anticipated and intended that future developments will occur, and that the disclosed systems and methods will be incorporated into such future embodiments.

All terms used in the claims are intended to be given their broadest reasonable constructions and their ordinary meanings as understood by those knowledgeable in the technologies described herein unless an explicit indication to the contrary is made herein. In particular, use of the singular articles such as "a," "the," "said," etc., should be read to recite one or more of the indicated elements unless a claim recites an explicit limitation to the contrary.

What is claimed is:

1. A child resistant closure for a container, comprising:

an inner cap rotatably retained within an outer cap;

the inner cap including a top wall and a depending side wall having an interior surface and an exterior surface, threads on the interior surface of the side wall of the inner cap, and gripping features on the exterior surface of the side wall of the inner cap; and the outer cap having a top wall and a depending lateral wall, the lateral wall having a first cutout section exposing the gripping features on the exterior surface of the side wall of the inner cap, and the lateral wall having a smooth interior surface that is free of protuberances, undulations and relief features that would otherwise enable effective transfer of torque from the outer cap to the inner cap.

2. The closure of claim 1, wherein the inner cap is rotatably retained within the outer cap by a circumferential lip portion that projects inwardly from an interior surface or lower edge of the lateral wall of the outer cap, and supports a lower edge of the side wall of the inner cap.

3. The closure of claim 1, wherein the gripping features are a plurality of ribs.

4. The closure of claim 1, wherein an upper surface of the top wall of the inner cap includes a first one-way ratchet ramp, and a lower surface of the top wall of the outer cap includes a second one-way ratchet ramp, whereby the first one-way ratchet ramp and the second one-way ratchet ramp are engageable with each other to allow the inner cap and the outer cap to be rotated together when the closure is screwed onto a bottle, and the first one-way ratchet ramp and the second one-way ratchet ramp allow the outer cap to rotate freely with respect to the inner cap when the outer cap is rotated in an opposite direction unless there is a predetermined amount of contact between the exposed exterior surfaces of the side wall of the inner cap and the thumb of a person rotating the outer cap.

5. The closure of claim 1, wherein an upper surface of the top wall of the inner cap includes a pair of one-way ratchet ramps, and a lower surface of the top wall of the outer cap includes a second pair of one-way ratchet ramps, whereby the pair of one-way ratchet ramps and the second pair of one-way ratchet ramps are engageable with each other to allow the inner cap and the outer cap to be rotated together when the closure is screwed onto a bottle, and the pair of one-way ratchet ramps and the second pair of one-way ratchet ramps allow the outer cap to rotate freely with respect to the inner cap when the outer cap is rotated in an opposite direction unless there is a predetermined amount of contact between the exposed exterior surfaces of the side wall of the inner cap and the thumb of a person rotating the outer cap.

6. The closure of claim 1, wherein the interior surface of the inner cap includes a stop that prevents the inner cap from being over-tightened onto a bottle, thereby facilitating removal of the closure from a bottle when pressure from an adult thumb is applied to the surfaces of the exterior surfaces of the side wall of the inner cap exposed through the first cutout section.

7. The closure of claim 6, wherein the lateral wall of the outer cap has a second cutout section exposing the gripping features on the exterior surface of the side wall of the inner cap, the first and second cutouts arranged opposite one another along the lateral wall.

8. A child-resistant closure for a container, comprising:

an inner cap rotatably retained within an outer cap;

the inner cap including a top wall and a depending side wall having an interior surface and an exterior surface, threads on the interior surface of the side wall of the inner cap, and gripping features on the exterior surface of the side wall of the inner cap; and the outer cap having a top wall and a depending lateral wall, the lateral wall having an upper cutout section exposing gripping features on a first section of the exterior surface of the side wall of the inner cap, and a lower cutout section exposing gripping features on a second section of the exterior surface of the side wall of the inner cap, the upper cutout section and the lower cutout section together defining a bridge portion of the lateral wall extending between and covering a section of the side wall of the inner cap between the upper cutout section and the lower cutout section, the lateral wall having a smooth interior surface that is free of protuberances, undulations and relief features that would otherwise enable effective transfer of torque from the outer cap to the inner cap.

9. The closure of claim 8, wherein the inner cap is rotatably retained within the outer cap by a circumferential lip portion that projects inwardly from an interior surface or lower edge of the lateral wall of the outer cap, and supports a lower edge of the side wall of the inner cap.

10. The closure of claim 8, wherein the gripping features are a plurality of ribs.

11. The closure of claim 8, wherein an upper surface of the top wall of the inner cap includes a first one-way ratchet ramp, and a lower surface of the top wall of the outer cap includes a second one-way ratchet ramp, whereby the first one-way ratchet ramp and the second one-way ratchet ramp are engageable with each other to allow the inner cap and the outer cap to be rotated together when the closure is screwed onto a bottle, and the first one-way ratchet ramp and the second one-way ratchet ramp allow the outer cap to rotate freely with respect to the inner cap when the outer cap is rotated in an opposite direction unless there is a predetermined amount of contact between the exposed exterior surfaces of the side wall of the inner cap and the thumb of a person rotating the outer cap.

12. The closure of claim 8, wherein an upper surface of the top wall of the inner cap includes a pair of one-way ratchet ramps, and a lower surface of the top wall of the outer cap includes a second pair of one-way ratchet ramps, whereby the pair of one-way ratchet ramps and the second pair of one-way ratchet ramps are engageable with each other to allow the inner cap and the outer cap to be rotated together when the closure is screwed onto a bottle, and the pair of one-way ratchet ramps and the second pair of one-way ratchet ramps allow the outer cap to rotate freely with respect to the inner cap when the outer cap is rotated in an opposite direction unless there is a predetermined amount of contact between the exposed exterior surfaces of the side wall of the inner cap and the thumb of a person rotating the outer cap.

13. The closure of claim 8, wherein the interior surface of the inner cap includes a stop that prevents the inner cap from being over-tightened onto a bottle, thereby facilitating removal of the closure from a bottle when pressure from an adult thumb is applied to the surfaces of the exterior surfaces of the side wall of the inner cap exposed through the upper cutout section and the lower cutout section of the outer cap.

14. The closure of claim 8, wherein the outer cap has two upper elongate cutout sections disposed opposite one another along the lateral wall, two lower elongate cutout sections disposed opposite one another along the lateral wall, and each upper cutout section associated with a lower cutout section together defining a bridge portion.

* * * * *